US005228748A

United States Patent [19]

Neumuller

[11] Patent Number: 5,228,748

[45] Date of Patent: Jul. 20, 1993

[54] SEAT CARRIER FOR CHAIRS

[75] Inventor: Konrad Neumuller, Burgthann, Fed. Rep. of Germany

[73] Assignee: Sifa Sitzfabrabrik GmbH, Sulzbach-Rosenberg, Fed. Rep. of Germany

[21] Appl. No.: 760,934

[22] Filed: Sep. 17, 1991

[51] Int. Cl.[5] ..... A47C 1/024

[52] U.S. Cl. ..... 297/374; 297/301

[58] Field of Search ..... 297/374, 375, 376, 313, 297/316, 354, 355, 300, 301, 302, 303, 304, 309, 379, 321

[56] References Cited

U.S. PATENT DOCUMENTS 4,062,587 12/1977 Wolters ..... 297/374 X
4,198,094 4/1980 Bjerknes et al. ..... 297/374 X
4,636,004 1/1987 Neumüller ..... 297/374
5,066,069 11/1991 DeGelder ..... 297/374

FOREIGN PATENT DOCUMENTS 401718 11/1933 United Kingdom ..... 297/374
8602536 5/1986 World Int. Prop. O. ..... 297/301

*Primary Examiner*—Laurie K. Cranmer
*Attorney, Agent, or Firm*—Thomas R. Morrison

[57] ABSTRACT

A seat carrier for chairs comprising a seat carrier, wherein into the slots in the legs of the back rest carrier, bushings are inserted which are shaped to match the slots in the front sector between the legs of the back rest carrier where a cross web is arranged, and in the rear sector, the legs of the back rest carrier are overlapped by a plate connected with the same.

6 Claims, 2 Drawing Sheets

SEAT CARRIER FOR CHAIRS

BACKGROUND OF THE INVENTION

The present invention relates to a seat carrier for chairs, particularly suitable for use in swivel office chairs.

European Patent No. 0198056 describes a seat carrier for chairs, especially for swivel office chairs. This carrier is described as comprising a U-shaped base structure containing legs pointed in an upward direction. At one end of the carrier there is a receptacle for a central support leg, a T-shaped seat plate carrier with lateral tabs directed in a downward direction. The seat plate carrier at its front end, i.e., the end closest to the cross member of the T, is pivotally connected with the base structure (at the end of the base structure which is opposite the receptacle) about a first arbor mounted to the legs of the base structure and the tabs of the seat carrier. The base structure extends from the connection with the seat plate carrier diagonally downward and in a rear direction.

The seat carrier further comprises a U-shaped back rest carrier whose legs point in a downward direction and which is pivotally-connected with the seat plate carrier, at the seat plate carrier's rear end, about a second arbor mounted in the tabs of the seat plate carrier and in a middle sector of the legs of the back rest carrier. A third arbor is mounted in matching holes in the legs of the base structure approximately in the middle of the connection with the seat plate and the receptacle for the supporting leg and in slots directed in a forward and a downward direction at the front end of the back rest carrier, and the tabs of the seat platform carrier at least partially encompass the legs of the back rest carrier, and the legs of the back rest carrier at least encompass the legs of the base structure.

Between the seat platform carrier and the base structure there are one more spring elements arranged in such a manner as to push these apart. Also, between the tabs of the seat platform carrier and the legs of back rest carrier are arranged two intermeshing lamellar stacks. One set of lamellar stacks at one end contains slots which are directed toward the slots of the back rest carrier in which the third arbor is guided and its other end its other end is pivotally mounted to bolts in the legs of the back rest carrier, while the other set of lamellar stacks contains at the end directed towards the slots of the back rest carrier contains slots in which the third arbour is guided and its other end is pivotally mounted to bolts in the tabs of the seat platform carrier. Coaxially to the third arbour chucking means connect the back rest carrier and the base structure.

However, the seat carrier of the prior art has several disadvantages in that under stress the individual parts can shift their position in relation to each other a way that the activation of the chucking means is no longer satisfactory, i.e., the lamellar stacks either become jammed to the legs of the base structure and the back rest carrier and are difficult to release, or they fail to lock sufficiently.

OBJECTS AND SUMMARY OF THE INVENTION

Accordingly, it is an object of the invention to provide a seat carrier which overcomes the drawbacks of the prior art.

It is a further object of the invention to provide a seat carrier in which the chucking means function properly with the lamellar stacks so that no excessive jamming or loosening will occur.

It is a still further object of the invention to provide a seat carrier wherein a cross web is welded to the legs of the back rest carrier.

According to an embodiment of the invention, there is provided a seat carrier, wherein into the slots in the legs of the back rest carrier, bushings are inserted which are shaped to match the slots in the front sector between the legs of the back rest carrier wherein a cross web is arranged, and in the rear sector, the legs of the back rest carrier are overlapped by a plate connected with the same. The cross web can be a separate inserted part, but it can also be an extension of the back rest carrier bent onto the legs of the back rest carrier.

According to a feature of the invention, there is provided a seat carrier comprising:

(a) a base structure containing legs pointed in an upward direction, and containing at one end a receptacle means for a central support leg;

(b) a seat plate carrier with lateral tabs extending in a downward direction, pivotally connected with the base structure at the end opposite the receptacle with a shaft mounted in the legs of the base structure and said tabs of said seat plate carrier, and wherein the base structure extends diagonally in a direction downward and a position away from the connection with the seat plate carrier, and wherein one or more spring means separate the seat plate carrier and the base structure;

(c) a back rest carrier containing legs pointed in a downward direction, pivotally connected with the seat plate carrier at its rear end with a second shaft mounted in the legs of the seat plate carrier and in a central sector of the legs of the back rest carrier; wherein another shaft is positioned in the legs of the base structure approximately in the middle between the connection with the seat plate carrier and the receptacle, wherein the tabs of the seat plate carrier at least partially encompass the legs of the back rest carrier, and wherein an open end of said back rest carrier is overlapped by a plate, the plate containing a lateral web positioned toward a longitudinal side;

(d) at least two intermeshing lamellar stacks contained between the tabs of the seat plate carrier and the legs of the back rest carrier, In a preferred embodiment of this invention, there is provided a back rest carrier for a seat fitting comprising:

a U-shaped member; and U-shaped member having a bottom and first and second legs;

a cross-web integrally formed with the bottom; the cross web being bent upward between the first and second legs; and ends of the cross-web being rigidly affixed to inside surfaces of the first and second legs, whereby the first and second legs are reinforced.

The above and other objects and advantages of the present invention will become apparent from the following description read in conjunction with the accompanying drawings, in which like reference numerals designate the same element.

DETAILED DESCRIPTION

Figure 1:
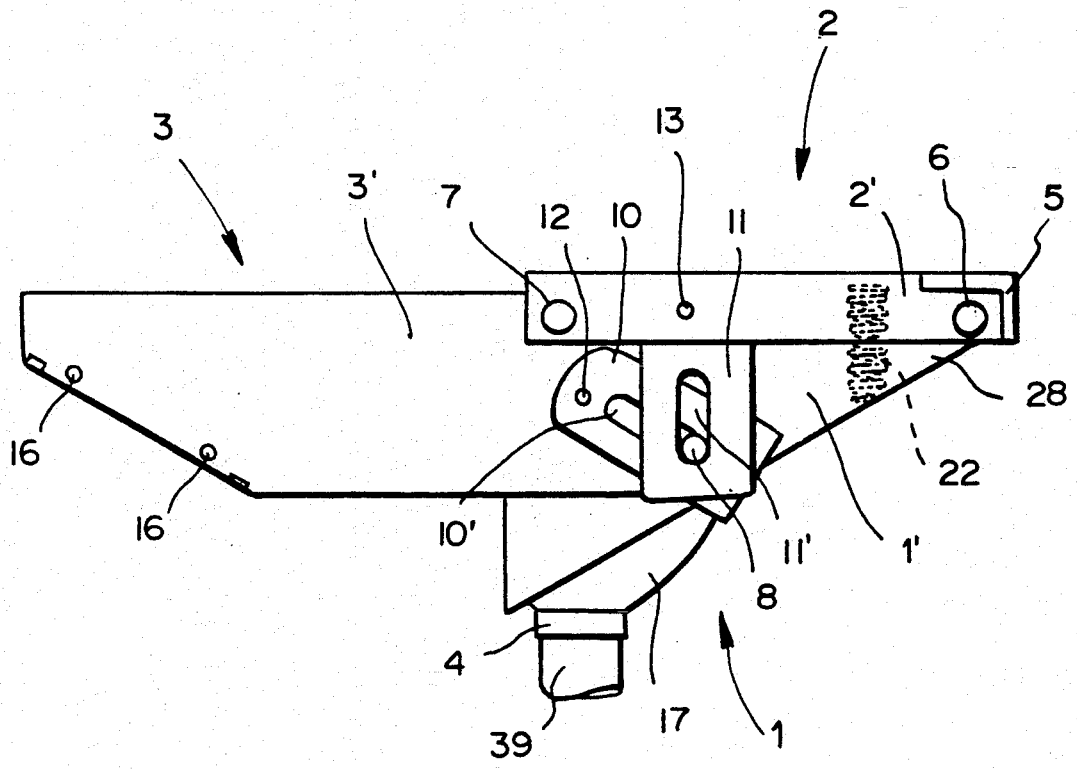
FIG. 1 is a lateral view of the seat carrier according to the invention without chucking means.
Figure 2:
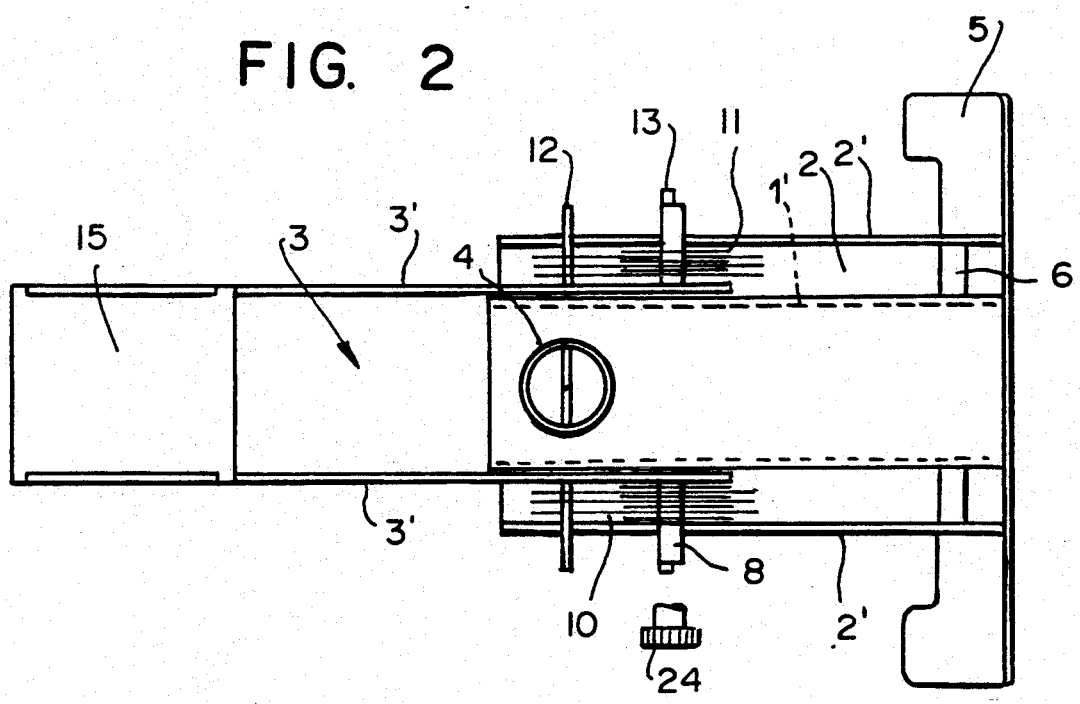
FIG. 2 is a view of the seat carrier from below.

Referring to FIGS. 1 and 2, the seat carrier comprises a base structure 1 of U-shape cross section and which have generally triangular side profile whose legs 1' have a rear part as at 26 and which have generally triangular side profile and are directed in an upward direction to a forward tip end of each as at 28. At its lower end, the seat carrier contains a receptacle 4 for a, e.g., floor engaging vertical central support leg 39. The forward tip end 28 of the base structure is pivotally connected with a T-shaped seat plate carrier 2 at the seat plate carrier's front end, where the cross member 5 of the T is situated. A first shaft 6 is mounted in the legs 1' of the base structure. The tabs 2' of the seat plate carrier 2 are directed in a downward direction, about which both are pivotable. At its rear end, the seat plate carrier 2 is pivotally connected with a back rest carrier 3, wherein a second shaft 7 is mounted in legs 3' of the back rest carrier 3.

Spring means 22 is contained between seat plate carrier 2 and the base structure 1, pushing these apart. Against the force of this spring, the seat plate carrier 2 and the base structure 1 can be moved, whereby the back rest carrier 3 is moved along due to the connection with the same. The flanges 2' of the seat plate carrier 2 partly overlap the back rest carrier 3 and the base structure 1.

Figure 3:
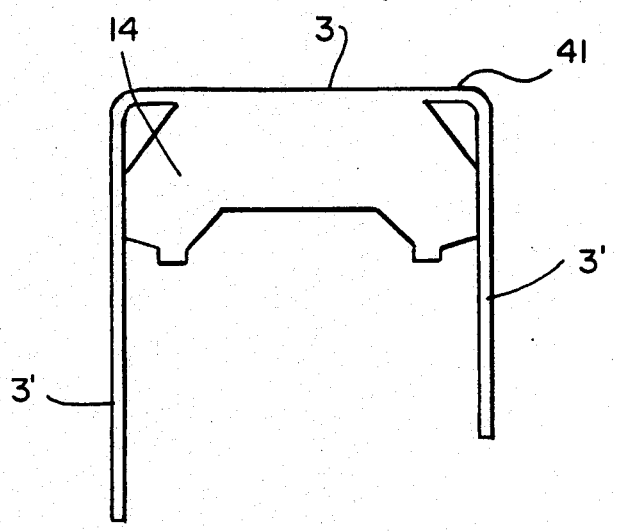
FIG. 3 is a frontal view of the back rest carrier.

The back rest carrier is of inverted U-shape cross section as seen in FIG. 3, and its legs 3' partly overlap base structure 1. Between legs 3' of the back rest carrier 3 and the flanges 2' of the seat plate carrier 2, first and second lamellar stacks 10 and 11 are positioned. Back rest carrier 3 includes a generally flat base part of the U shape as at 41 (best seen in FIG. 3) which extends between the legs 3'. At one end the individual lamellar stacks contain slots 10' and 11' in which a third shaft 8 is guided. The slots 10' and 11' of the lamellar stacks 10 and 11 can be of the same length as the slots of the back rest carrier 3, or optionally, to limit the available lift, they may be shorter than the slots of the back rest carrier 3. At the other end, the lamellar stacks 10 and 11 are rotatably mounted on bolts 12 and 13. The first lamellar stack 10 is positioned on crossbolt 12 in legs 3' of the back rest carrier 3, and the second lamellar stack 11 is positioned in the flanges 2' of the seat plate carrier 2.

In a preferred embodiment of this invention, the bolts 12 and 13 connecting the lamellar stacks 10 and 11 with the legs 3' are crossbolts 12 and 13 each extending through both legs 3'. The legs 1' of the base structure 1 contain notches (not shown) in which the crossbolt 12 for the lamellar stacks 10 and 11 mounted in the legs 3' of the back rest carrier 3 meet when the extreme diagonal position of the back rest carrier is reached. At this juncture, the base structure 1 is braced, from the receptacle 4 for the central support leg to the notches (not shown) in its legs, by a deformation or use of a reinforcement member at its base surface.

On the third shaft 8, a chucking means 24 of, e.g., the type disclosed in the above mentioned European Application 0198056 (commonly owned U.S. Pat. No. 4,636,004 also discloses lamellar stack construction and locking means therefor) is positioned for the frictional connection of lamellar stacks 10 and 11 with legs 3' of the back rest carrier 3. The chucking means comprise an eccentric element and/or a spring interacting with a lever. As one of ordinary skill in the art recognizes, with the lamellar stacks located between the flanges of the seat plate carrier and the sides of the back rest carrier, operation of the chucking means to lock the stacks one with the other results in locking of the seat plate carrier to the back rest carrier as a unit therewith.

FIG. 1 also depicts the use of a reinforcement member 17 which serves to reinforce the base structure 1. The legs 1' of the base structure 1 contain notches in which crossbolt 12 for the lamellar stacks 10 and 11 mounted in the legs 3 of the back rest carrier 3 comes into position when the extreme diagonal position of the back rest carrier 3 is reached.

The base structure 1 is braced, from the receptacle 4 for the central support leg to the notches in its legs 1' by or the reinforcement member 17.

FIGS. 1 and 2 also depict the arrangement of plate 15 which contains lateral tabs or ears and is inserted between the legs 3' of the back rest carrier 3 and is connected with these by screws 16.

Figure 4:
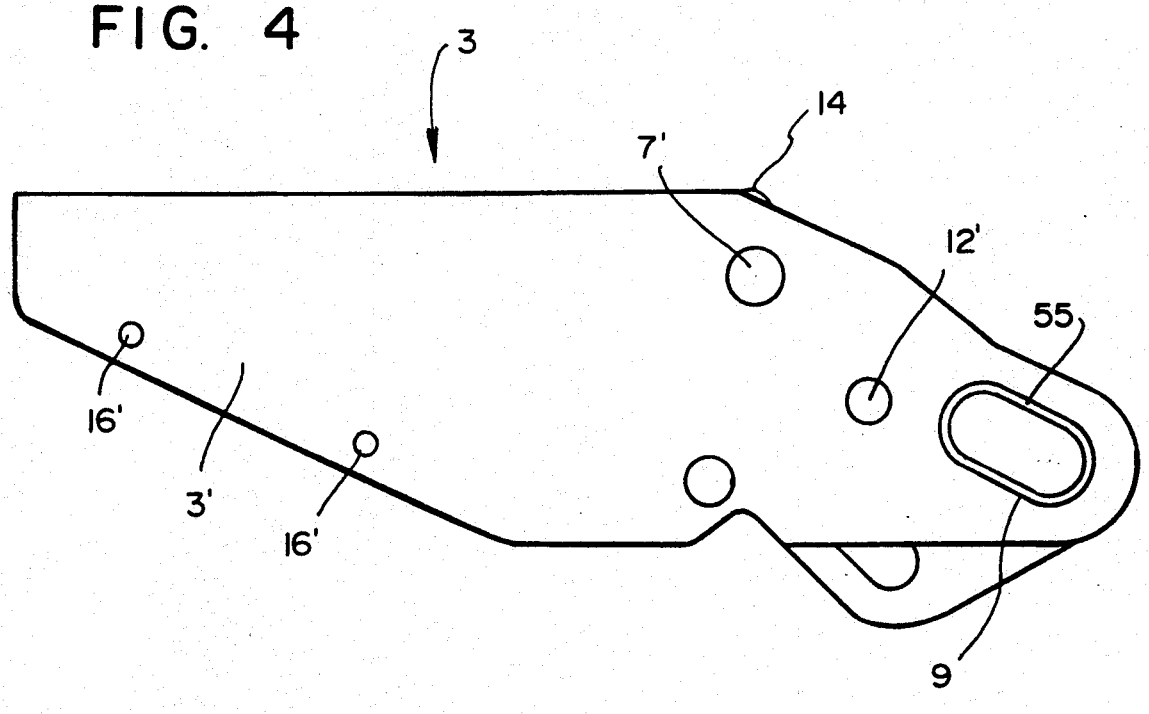
FIG. 4 is a lateral view of the back rest carrier.

FIGS. 3 and 4 depict the back rest carrier 3, with screw holes 16' for reception of the screws 16 which secure plate 15 to the back rest carrier, slots 9 in which shaft 8 locates holes 7' and 12' for the second shaft 7 and the crossbolt mounted in the legs 3' of carrier 3. Also shown is cross web 14 which is formed so that a part of the base of the back rest carrier 3 is bent in a downward position and tacked or welded to the legs 3'. According to this invention, a bushing 55 (FIG. 4) made of a harder material is used in slots 9 for the third shaft to move.

In the present invention, advantageously the plate overlapping the legs of the back rest carrier contains tabs or ears positioned in an upward direction and bolted or welded to the back rest carrier in at least four places.

The bushings 55 as heretofore described are made from a hardened material such as heat treated steel, although they may be provided with contact surfaces for the third shaft that are wear-resistant by hardening or with a coating.

Since the back rest carrier 3 is designated as U-shaped, which according to the present is overlapped at its open side by a plate 15 and contains a lateral web 14 positioned toward one longitudinal side, it has a box-like shape. Due to this shape, the back rest carrier has excellent torsional rigidity, so that the function of the laminar stacks is assured even under excessive stress.

Having described preferred embodiments of the invention with reference to the accompanying drawings, it is to be understood that the invention is not limited to the precise embodiments and that various changes and modifications may be affected therein by one skilled in the art without departing from the scope or spirit of the invention which is limited only by the appended claims.

What is claimed is:

1. In a seat carrier for chairs, a base support fixed upright at a rear thereof to a vertical support leg, the base support having a front tip end in which a first end of a seat plate carrier is pivoted, bias means engaged with the base support and with the seat plate carrier urging the seat plate carrier upwardly of the base support, a back rest carrier pivoted at a front end thereof to a second opposite end of the seat plate carrier, cooperating intermeshing lamellar stack elements carried on the seat plate carrier and the back rest carrier and actuatable to lock the seat plate carrier to the back rest carrier, the back rest carrier being of an inverted U shaped cross section having a generally flat base piece and a pair of spaced apart legs extending downwardly from the base piece, the back rest carrier having a cross web depending downwardly from a forward end of the base piece between the spaced apart legs and fixedly secured thereto, and a plate spanning between lower rear parts of the back rest carrier legs and secured thereto, said cross web and plate defining with the back rest carrier base piece and legs, a box-like structure having enhanced, torsional rigidity.

2. The seat carrier of claim 1 in which the base support is a U shaped member having a U base and legs extending upwardly from the U base at opposite sides thereof, the carrier further comprising a base support reinforcement member intervening the upright support leg and said U base and fixed to the latter.

3. The seat carrier of claim 1 in which the plate is fixed to the back rest carrier legs with screws.

4. The seat carrier of claim 1 in which the cross web is secured to the back rest carrier legs with a tack weldment.

5. The seat carrier of claim 1 in which the cross web is integral with the back rest carrier base piece.

6. The seat carrier of claim 1 in which the intermeshing stack elements are received on a shaft carried in the legs of the base support, the shaft passing through slots in the back rest carrier legs, the slots being provided with bushings on which the shaft moves.

* * * * *